US006679319B1

(12) United States Patent
Kato

(10) Patent No.: US 6,679,319 B1
(45) Date of Patent: Jan. 20, 2004

(54) HEAT EXCHANGER

(75) Inventor: Soichi Kato, Saitama (JP)

(73) Assignee: Zexel Valeo Climate Control Corporation, Saitama (JP)

( * ) Notice: Subject to any disclaimer, the term of this patent is extended or adjusted under 35 U.S.C. 154(b) by 0 days.

(21) Appl. No.: 09/831,107

(22) PCT Filed: Dec. 2, 1998

(86) PCT No.: PCT/JP98/05416

§ 371 (c)(1),
(2), (4) Date: May 4, 2001

(87) PCT Pub. No.: WO00/33010

PCT Pub. Date: Jun. 8, 2000

(51) Int. Cl.[7] ..... F25B 39/04; F28F 9/007

(52) U.S. Cl. ..... 165/132; 165/70; 165/178; 62/509

(58) Field of Search ..... 165/132, 178, 165/70; 62/509

(56) References Cited

U.S. PATENT DOCUMENTS 5,467,611 A * 11/1995 Cummings et al. ..... 62/299
5,709,106 A * 1/1998 Inaba et al. ..... 62/509
5,884,503 A * 3/1999 Inaba ..... 62/509
5,901,573 A * 5/1999 Kobayashi ..... 62/509
5,937,671 A * 8/1999 Inoue et al. ..... 62/509
6,065,534 A * 5/2000 Sircar ..... 165/178

FOREIGN PATENT DOCUMENTS

JP 4-25984 * 3/1992

* cited by examiner

*Primary Examiner*—Leonard Leo
(74) *Attorney, Agent, or Firm*—Kanesaka & Takeuchi

(57) ABSTRACT

A heat exchanger has a connector (7) for connecting a receiver tank (4) brazed to a header pipe (3) and the receiver tank (4) connected to the connector (7) by male screw parts, wherein the connector (7) is formed to have a brazing face (7*a*) against the header pipe (3) narrower than a mating face (7*b*) against the receiver tank (4). The connector (7) has a plurality of holes (73), (73) into which a plurality of male screw parts are inserted or screwed, and the holes (73), (73) are formed symmetrically or substantially symmetrically on the brazing face (7*a*) against the header pipe (3) with respect to a straight line connecting the center of an outflow path (71) and that of an inflow path (72) on the mating face (7*b*) against the receiver tank (4). And, a groove (74) which divides the brazing face (7*a*) is formed between the inflow path (71) and the outflow path (72) on the brazing face (7*a*) against the header pipe (3).

1 Claim, 4 Drawing Sheets

HEAT EXCHANGER

TECHNICAL FIELD

The present invention relates to a heat exchanger which has a connector for connecting with a receiver tank and brazed to a header pipe, and the receiver tank connected with the connector by male screw parts.

BACKGROUND ART

Generally, a heat exchanger used for a vapor compression type refrigerating cycle or the like of an air-conditioning device for vehicles is known comprised of heat-exchanging tubes for a cooling medium connected with header pipes for distributing and collecting the cooling medium, and a receiver tank for temporarily accumulating the aggregated cooling medium connected with the header pipe (for example, a condenser described in Japanese Patent Application Laid-Open Publication No. 9-217967).

As such a type of heat exchanger, in addition to one configured to supply the cooling medium accumulated in the receiver tank directly to an evaporator, there is especially known a so-called sub-cool condenser which is configured to send the cooling medium accumulated in the receiver tank back to the header pipe, to further cool it in the tubes and to supply to the evaporator. This sub-cool condenser can improve a cooling efficiency of the cooling medium.

Besides, the heat exchanger has the header pipe and the receiver tank connected with a connector 8 interposed therebetween as shown in FIG. 4(A) and FIG. 4(B).

The connector 8 shown in the drawings is used for the aforesaid sub-cool condenser, brazed to the header pipe and also connected to the receiver tank by a male screw part such as a bolt.

Specifically, an outflow path 81 for outflowing the cooling medium to the receiver tank and an inflow path 82 for inflowing the cooling medium from the receiver tank are disposed between a brazing face 8*a* against the header pipe and a mating face 8*b* against the receiver tank, and a hole 83 into which the male screw part is screwed is formed on the mating face 8*b*.

Conventionally, the connectors of the aforesaid heat exchanger need to form the hole into which the male screw part is inserted or screwed and therefore must be formed large to some extent. As a result, there was a disadvantage that the heat exchanger becomes large and heavy.

Especially, where the heat exchanger is mounted on a vehicle, it was very disadvantageous to use a large and heavy connector in terms of arrangement with other devices.

And, where the connector is large, the heat capacity required for brazing the header pipe and the connector increases, resulting in a disadvantage that their brazing becomes difficult.

In addition, the connector used for the sub-cool condenser has the outflow path for outflowing the cooling medium to the receiver tank and the inflow path for inflowing the cooling medium from the receiver tank positioned on the mating face with the receiver tank as described above. Therefore there was also a disadvantage that it was difficult to balance a supporting strength between the receiver tank and the connector by the male screw part.

On the brazing face between the header pipe and the connector, bypass leakage might be caused in the outflow path and the inflow path due to a defective brazing. Such bypass leakage becomes a cause of considerable lowering of the function of the heat exchanger but its detection is quite difficult because it does not involve external leakage.

In view of the aforesaid drawbacks, it is an object of the invention to provide a heat exchanger which can efficiently connect the header pipe and the receiver tank.

DISCLOSURE OF THE INVENTION

The invention recited in claim 1 is a heat exchanger comprising tubes for heat-exchanging a cooling medium, header pipes connected to the tubes for distributing and collecting the cooling medium and a receiver tank connected to the header pipe for temporarily storing the cooling medium, the header pipe being provided with a connector by brazing for connecting with the receiver tank, and the receiver tank and the connector being connected by male screw parts, wherein

- the connector has a brazing face along a longitudinal direction of the header pipe and which has a curvature to externally fit the header pipe, and a mating face to be connected to the receiver tank;
- the connector has an outflow path for outflowing the cooling medium from the header pipe to the receiver tank, an inflow path for inflowing the cooling medium from the receiver tank to the header pipe, and a plurality of holes into which a plurality of the male screw parts are inserted or screwed;
- the connector is so formed that its brazing face against the header pipe is narrower than a mating face of the receiver tank and a plurality of holes into which the male screw parts are inserted or screwed formed on the mating face larger than the brazing face; and
- the connector is formed with a groove between the inflow path and the outflow path on the brazing face against the header pipe so to divide the brazing face.

Thus, according to the heat exchanger of the invention, the connector is formed to have the brazing face against the header pipe narrower than the mating face against the receiver tank, so that the connector is formed to have a reduced size and weight, and the brazing property between the header pipe and the connector is improved.

Specifically, the connector connected to the receiver tank by the male screw parts needs holes into which the male screw parts are inserted or screwed and has to be formed to have a predetermined large size, causing a disadvantage of making the heat exchanger large in size and heavy. But, according to the connector of the invention, the brazing face against the header pipe is formed to be narrower than the mating face against the receiver tank, allowing to make the connector smaller and lighter in weight and reducing the above disadvantages.

Particularly, where the heat exchanger is mounted on a vehicle or the like, a disadvantage involved in the layout with other devices can be reduced because a relatively small and lightweight connector is used.

Where the connector is large, the heat capacity required for brazing the header pipe and the connector increases. But, according to the present invention, the increase in the heat capacity is avoided and the brazing property is improved because the brazing face against the header pipe is narrower than the mating face against the receiver tank.

And, according to the heat exchanger of the invention, the connector has the outflow path for outflowing the cooling medium to the receiver tank, the inflow path for inflowing the cooling medium from the receiver tank, and the groove formed between the inflow path and the outflow path on the brazing face against the header pipe so to divide the brazing face. Therefore, on the brazing face between the header pipe and the connector, bypass leakage which might be caused in the outflow path and the inflow path due to a defect in brazing can be detected readily because the leakage becomes external leakage through the groove.

The bypass leakage in the outflow path and the inflow path considerably lowers the function of the heat exchanger but its detection was quite difficult. According to the present invention, even such a bypass leakage can be detected as an external leakage by virtue of the groove.

BEST MODE FOR CARRYING OUT THE INVENTION

The embodiment of the invention will be described in detail with reference to the accompanying drawings.

Figure 1:
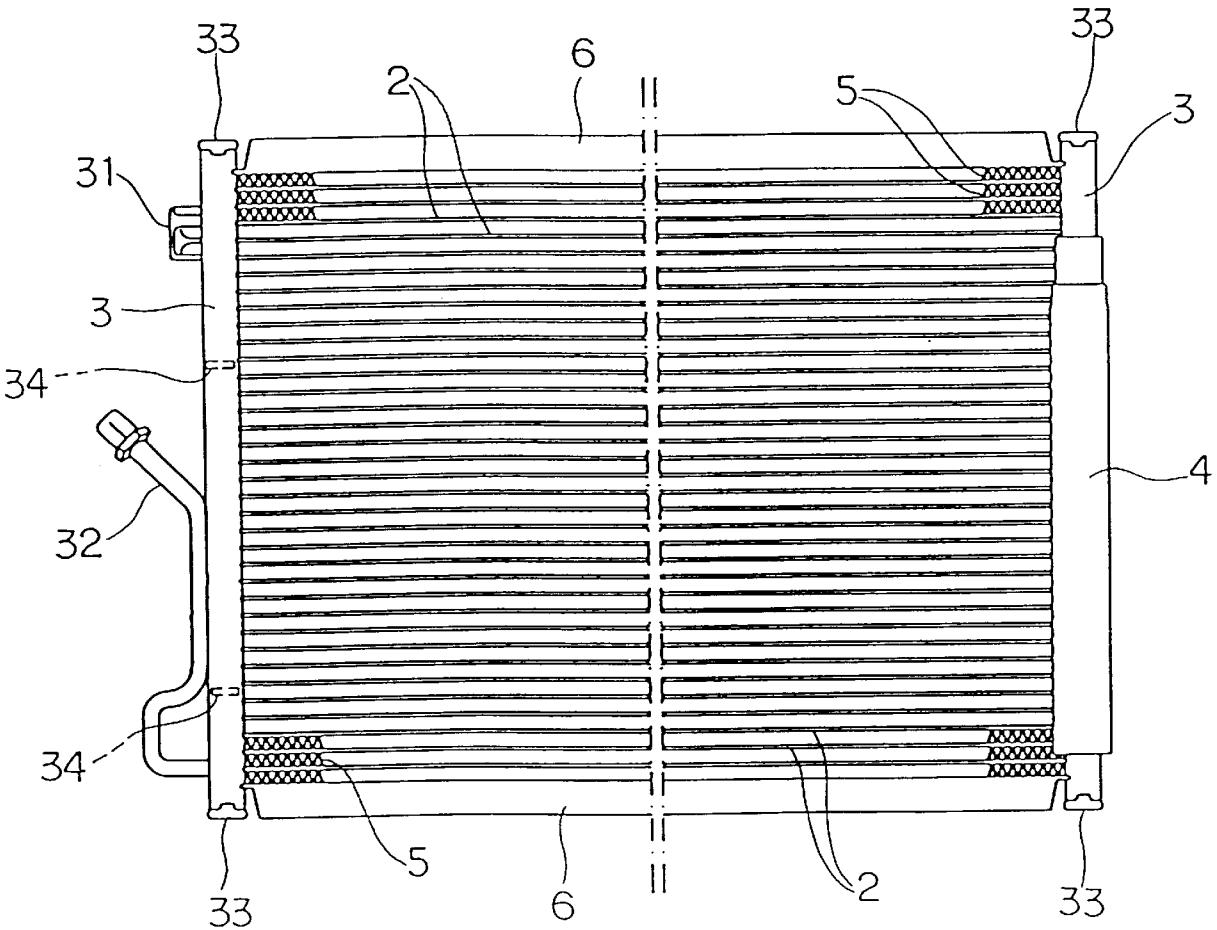
FIG. 1 is a front view of the heat exchanger according to an embodiment of the invention.

As shown in FIG. 1, a heat exchanger 1 of this embodiment is a sub-cool condenser which comprises a plurality of tubes 2, 2 for heat-exchanging a cooling medium, a pair of header pipes 3, 3 which are connected to respective ends of the tubes 2, 2 to distribute and collect the cooling medium, and a receiver tank 4 which is connected to one of the header pipes 3, 3 to temporarily store the cooling medium.

The respective tubes 2, 2 are disposed in a stacked form, and fins 5, 5 for improving a heat exchange efficiency of the cooling medium are disposed between the tubes 2, 2. Besides, side plates 6, 6 which have their either ends supported by the header pipes 3, 3 are disposed on the top and bottom of the layer consisting of the tubes 2, 2 and the fins 5, 5.

The respective header pipes 3, 3 are made of a cylindrical member, provided with an inlet joint 31 for receiving the cooling medium and an outlet joint 32 for supplying the cooling medium, and their top and bottom ends are closed by caps 33, 33. Interiors of header pipes are divided into predetermined intervals by partition plates 34, 34.

By configuring as described above, the cooling medium is taken into the heat exchanger 1 through the inlet joint 31 of the header pipes 3, 3, flows through the tubes 2, 2 while heat-exchanging, meanders a plurality of times between the header pipes 3, 3, and discharged outside through the outlet joint 32 of the header pipes 3, 3. And, the cooling medium is condensed while it is taken into and discharged outside and temporarily stored in the receiver tank 4. The cooling medium stored in the receiver tank 4 is returned again to the header pipe 3 and passed through the predetermined tubes 2, 2 so it is cooled.

Desiccant is disposed within the receiver tank 4, so that the cooling medium is dehydrated by the desiccant while it is passing through the receiver tank 4.

Figure 2:
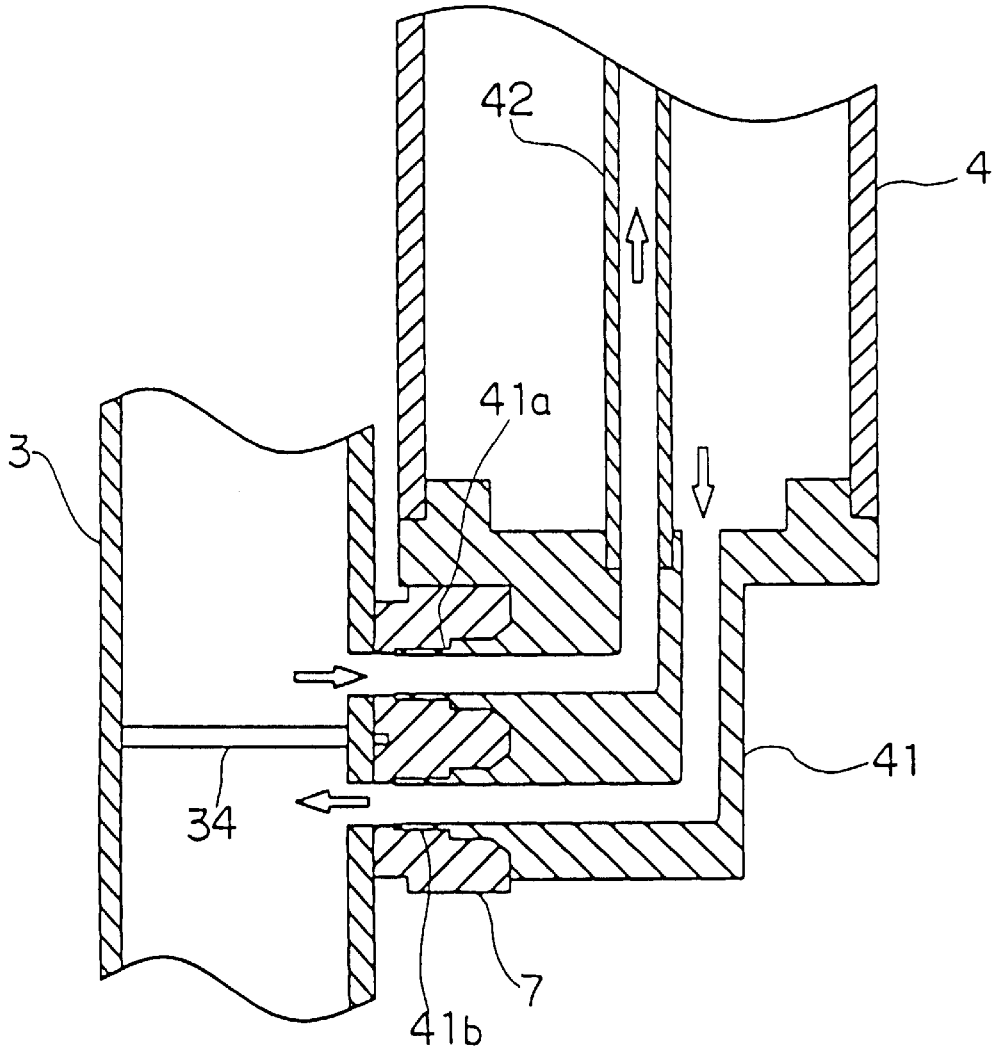
FIG. 2 is a sectional view showing the header pipe, receiver tank and connector according to the embodiment of the invention.
Figure 3:
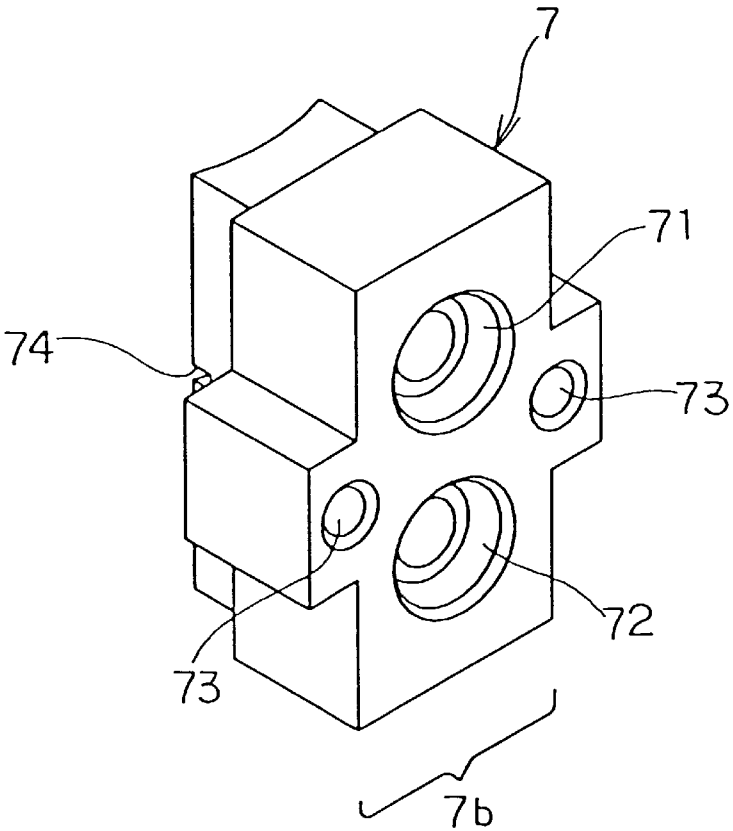
FIG. 3(A) is an external view of the brazing face of the connector viewed from the header pipe.
FIG. 3(B) is an external view of the mating face of the connector viewed from the receiver tank according to the embodiment of the invention.
Figure 3:
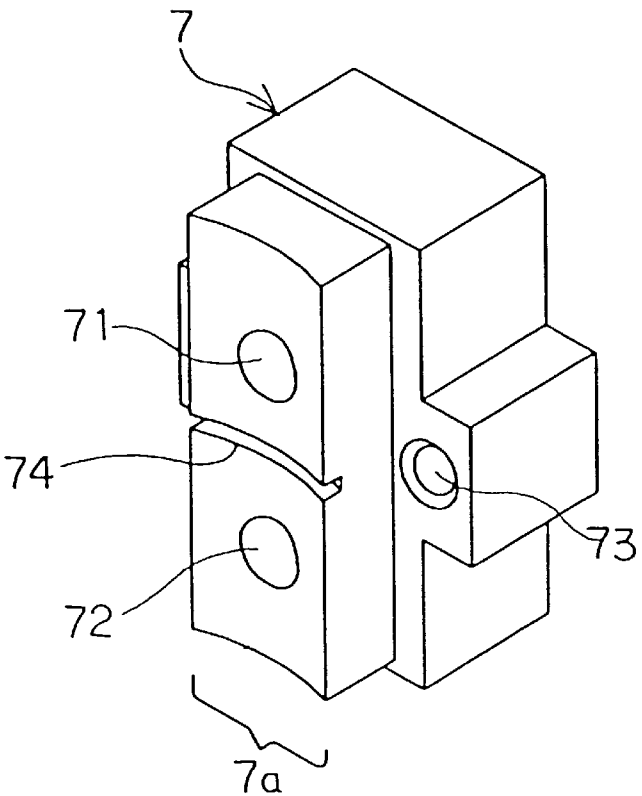
Figure 4B:
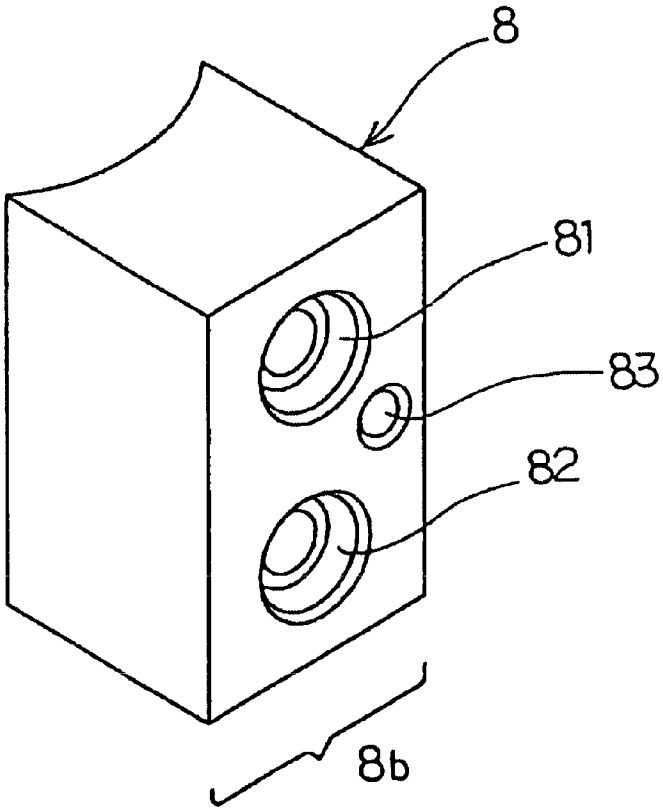
FIG. 4(B) PRIOR ART
FIG. 4(B) is an external view of the mating face of the connector viewed from the receiver tank, according to a prior art.
Figure 4A:
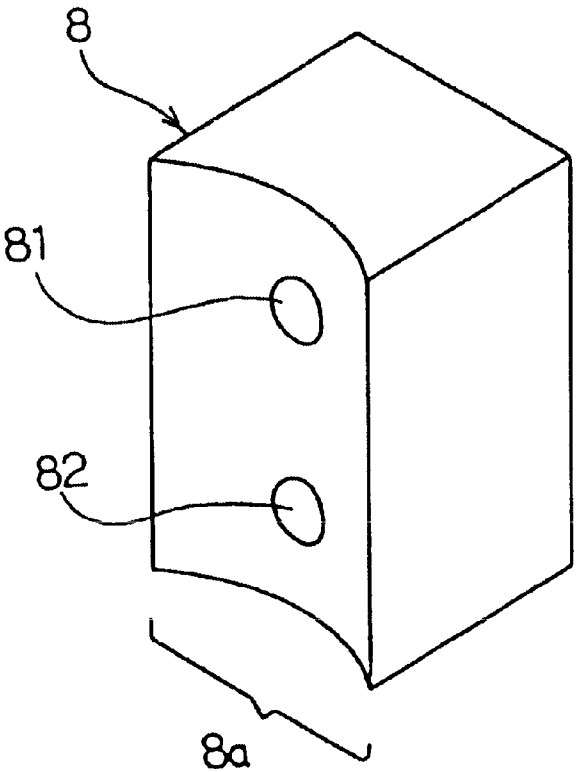
FIG. 4(A) PRIOR ART
FIG. 4(A) is an external view of the brazing face of the connector viewed from the header pipe.

The header pipe 3 and the receiver tank 4 are connected with a connector 7 therebetween shown in FIG. 2 to FIG. 3(B).

The connector 7 of this embodiment is brazed to the header pipe 3 and connected to the receiver tank 4 by the male screw parts.

Meanwhile, a block 41 corresponding to the connector 7 is disposed at the lower part of the receiver tank 4.

This block 41 is a member having a passage for flowing the cooling medium and has fitting sections 41*a*, 41*b* for fitting to an outflow port 71 and an inflow port 72 of the connector 7 to be described afterward and holes (not shown) in which the male screw parts are screwed or inserted. And, as indicated by an arrow in FIG. 2, the cooling medium flows from the outflow port 71 to the receiver tank 4 is suctioned up by a suction pipe 42 disposed at the center of the interior of the receiver tank 4 and then dropped to be accumulated in the bottom of the receiver tank 4. Besides, the cooling medium accumulated in the bottom of the receiver tank flows from the inflow port 71 of the connector 7 into the header pipe 4.

The connector 7 is formed by machining an extruded member so to have a brazing face 7*a* against the header pipe 3 provided with a curvature to externally fit the header pipe 3 and its edge portion cut so to be narrower than a mating face 7*b* against the receiver tank 4. And, the outflow port 71 for outflowing the cooling medium from the header pipe 3 to the receiver tank 4 and the inflow port 72 for inflowing the cooling medium from the receiver tank 4 to the header pipe 3 are disposed between the brazing face 7*a* and the mating face 7*b*.

In addition, a plurality of holes 73, 73 into which the male screw parts are inserted or screwed are formed on necessary portions of the connector 7.

Such plurality of holes 73, 73 are formed symmetrically or substantially symmetrically on the mating face 7*b* against the receiver tank 4 with respect to a straight line connecting the center of the outflow port 71 and that of the inflow port 72 and are also extended to the side of the connector 7.

In this embodiment, the contour of the mating face 7*b* is formed into substantially a cross shape. Specifically, it is configured to efficiently arrange the outflow port 71, the inflow port 72 and the holes 73, 73 with respect to the mating face 7*b* having a small area.

A groove 74 which divides the brazing face 7*a* is formed between the inflow port 71 and the outflow port 72 of the brazing face 7*a*.

Specifically, where bypass leakage is caused in the outflow port 71 and the inflow port 72 on the brazing face 7*a* against the header pipe 3 due to a defect in brazing, external leakage is caused through the groove 74, so that it is easily detected.

The header pipe 3 and the connector 7 are brazed by a jig to integrate the tubes 2, 2, the header pipes 3, 3, the fines 5, 5, the side plates 6, 6, the inlet joints 31, 31, the outlet joint 32, the caps 33, 33, the partition plates 34, 34 and the connector 7 into one body, and the assembly is heat treated in a furnace. Specifically, the header pipe 3 and the connector 7 are brazed together with the other brazing portions of the heat exchanger 1 by one operation. Clad and flux of the brazing material are properly coated on the necessary portions of the respective members which configure the heat exchanger 1.

External leakage of the heat exchanger 1 is inspected by assembling the receiver tank 4 after brazing the respective members and injecting an inspection gas into the receiver tank 4.

According to the heat exchanger of this embodiment described above, the connector is formed with its brazing face against the header pipe narrower than the mating face against the receiver tank, so that the connector can be reduced in size and weight, and the brazing property between the header pipe and the connector can be improved.

Specifically, the connector which is connected to the receiver tank by the male screw parts requires to have holes into which the male screw parts are inserted or screwed, so that it must be formed to have a certain size, causing a drawback of making the heat exchanger large and heavy. But, such a drawback can be reduced by the connector of this embodiment because the brazing face against the header pipe is formed narrower than the mating face against the receiver tank, so that the connector can be made relatively small and lightweight.

Especially, where the heat exchanger is mounted on a vehicle or the like, a disadvantage involved in the layout with other devices can be reduced because the connector used is relatively small and lightweight.

If the connector is large, the heat capacity required for brazing the header pipe with the connector increases, but according to this embodiment, the brazing face for brazing with the header pipe is formed narrower than the mating face against the receiver tank, so that the heat capacity can be prevented from increasing, and the brazing property can be improved.

Besides, according to the heat exchanger of this embodiment, the connector has the outflow path for outflowing the cooling medium to the receiver tank, the inflow path for inflowing the cooling medium from the receiver tank, and the plurality of holes into which the plurality of male screw parts are inserted or screwed, and the plurality of holes are formed on the mating face against the receiver tank symmetrically or substantially symmetrically with respect to the straight line connecting the center of the outflow path and that of the inflow path. Thus, the supporting strength of the receiver tank and the connector by the plurality of male screw parts can be secured in a good balance, and the cooling medium can be securely prevented from leaking from the mating face.

Furthermore, according to the heat exchanger of this embodiment, the holes of the connector are extended to the side of the connector, so that the size and weight of the connector can be reduced.

In other words, the enlargement and weight increase of the connector due to the formation of the holes can be reduced by extending the holes.

Especially, the contour of the mating face of the connector can be substantially a cross shape.

In addition, according to the heat exchanger of this embodiment, the connector has the outflow path for outflowing the cooling medium to the receiver tank and the inflow path for inflowing the cooling medium from the receiver tank, and the groove which divides the brazing face is formed between the outflow path and the inflow path on the brazing face against the header pipe, so that the occurrence of the bypass leakage in the outflow path and the inflow path due to a defect in the brazing on the brazing face between the header pipe and the connector can be detected easily because it becomes the external leakage through the groove.

The bypass leakage in the outflow path and the inflow path becomes a cause of considerably lowering the functions of the heat exchanger, but it was difficult to detect it. According to this embodiment, however, such bypass leakage can be detected as the external leakage by virtue of the groove.

INDUSTRIAL APPLICABILITY

The present invention is the heat exchanger having the receiver tank-connecting connector brazed to the header pipe and connecting the receiver tank and the connector by the male screw parts, and can connect the header pipe and the receiver tank efficiently, so that it is particularly suitable for the heat exchanger of a type having a relatively high medium pressure.

What is claimed is:

1. A heat exchanger comprising:

a plurality of tubes for heat-exchanging a cooling medium;

first and second header pipes connected to said tubes through which said cooling medium flows;

a receiving tank for temporarily storing said cooling medium; and a connector fixed to said first header pipe by brazing and said receiving tank by screwing so that said first header pipe and receiving tank are connected to each other through said connector, said connector including a brazing face provided along a longitudinal direction of said first header pipe and having a curvature to fit said first header pipe for tight brazing therebetween, a mating face having a plurality of holes for screwing said receiving tank to said connector, and outflow and inflow paths passing through said connector so that said cooling medium flows from said first header pipe to said receiving tank or vice versa, wherein said brazing face is made smaller than said mating face and has a groove between said outflow and inflow paths so as to divide said brazing face, and said plurality of holes are provided in extended portions provided on opposite sides of said mating face such that they are arranged substantially symmetrically with respect to a straight line connecting centers of said outflow and inflow paths.

* * * * *